US005202698A

United States Patent [19]

Jelloul

[11] Patent Number: 5,202,698

[45] Date of Patent: Apr. 13, 1993

[54] DIRECTIONAL RADIOCOMMUNICATION ARRAY

[75] Inventor: Mostafa Jelloul, Verrieres-le-Buisson, France

[73] Assignee: Societe Technique d'Application et de Recherche Electronique, France

[21] Appl. No.: 763,298

[22] Filed: Sep. 20, 1991

[30] Foreign Application Priority Data

Sep. 21, 1990 [FR] France ..... 90 11672

[51] Int. Cl.[5] ..... H01Q 13/10

[52] U.S. Cl. ..... 343/770; 343/700 MS

[58] Field of Search ..... 343/770, 771, 767, 700 MS, 343/768, 850, 844

[56] References Cited

U.S. PATENT DOCUMENTS

| | | | |
|---|---|---|---|
| 4,353,072 | 10/1982 | Monser | 343/725 |
| 4,356,497 | 10/1982 | Dudome | 343/771 |
| 4,843,403 | 6/1989 | Lalezari et al. | 343/700 MS |
| 5,023,623 | 6/1991 | Kreinheder et al. | 343/770 |

FOREIGN PATENT DOCUMENTS

| | | |
|---|---|---|
| 0257881 | 3/1988 | European Pat. Off. . |
| 0349069 | 1/1990 | European Pat. Off. . |
| 1565266 | 2/1970 | Fed. Rep. of Germany . |

*Primary Examiner*—Rolf Hille
*Assistant Examiner*—Hoanganh Le
*Attorney, Agent, or Firm*—Wegner, Cantor, Mueller & Player

[57] ABSTRACT

A directional radiocommunication array for radiocommunication antennas comprises an array of N adjacent radiating elements connected in series by a main line and spaced by a quarter-wavelength on the main line. The directional array comprises an insulative substrate on a first side of which are disposed along a first direction adjacent radiating elements in the form of thin metal layers, each radiating element comprising a radiating slot which widens in a linear manner to either side of an axis from a short-circuited secondary slot line on this axis perpendicular to the first direction and parallel to a second or main propagation direction. Each radiating element is insulated from an adjacent element by a decoupling short-circuited quarter-wavelength slot line. The main line is a coaxial cable substantially perpendicular to each secondary slot line and having a central core and an outer conductive sheath. The sheath of the coaxial cable is stripped at each secondary line over a length substantially equal to the width of the secondary line and connected to two excitation points of the secondary line.

8 Claims, 8 Drawing Sheets

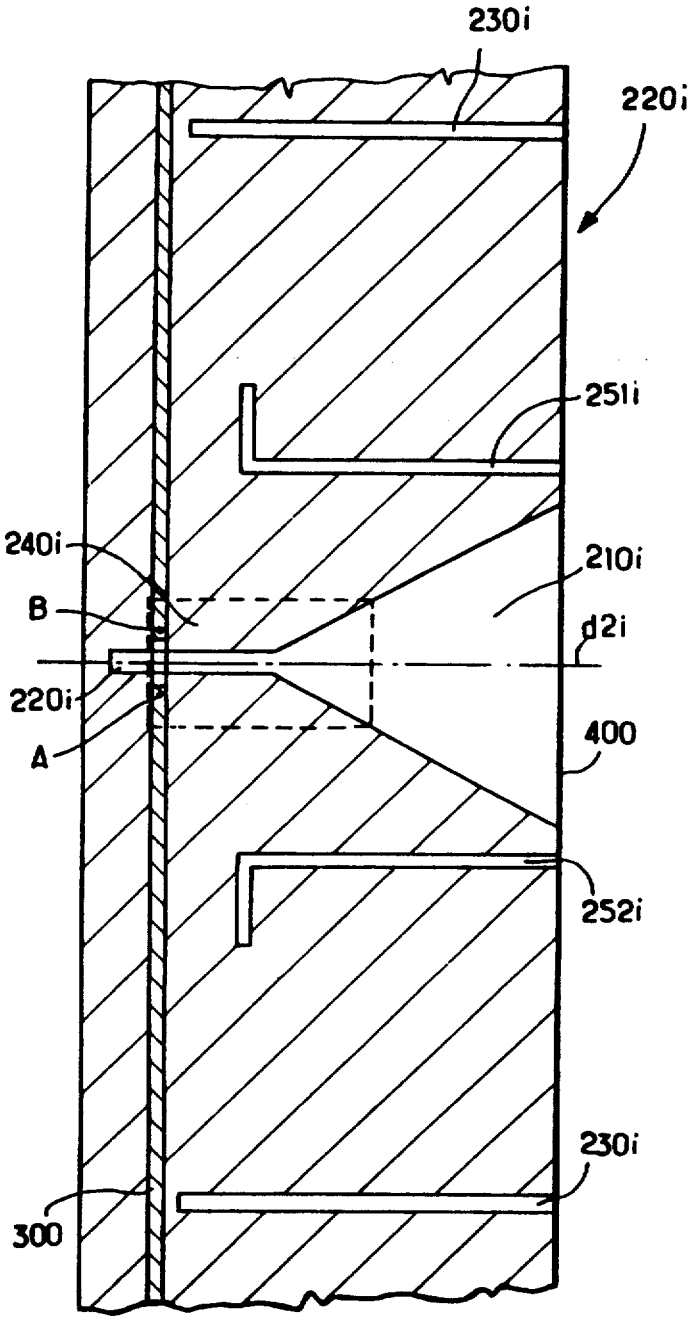
FIG. 2
FIG. 3a
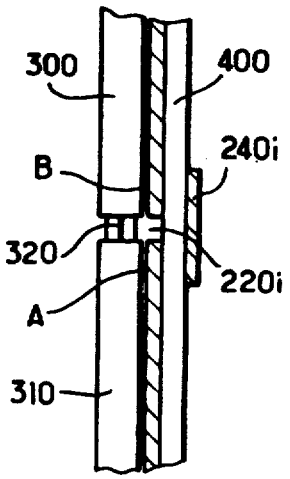
FIG. 3b
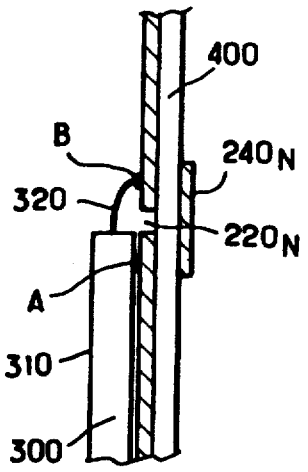

DIRECTIONAL RADIOCOMMUNICATION ARRAY

BACKGROUND OF THE INVENTION

1. Field of the Invention

The present invention concerns a directional radiocommunication array comprising a plurality of adjacent radiating elements connected in series by a main line and spaced by one wavelength on said main line. It concerns also a set of such directional arrays.

The invention has a particularly advantageous application in the field of radiocommunication antennas in the UHF band and up into the X band when strong directivity in the plane of the array and weak directivity in the perpendicular plane are required. For example, if the array is disposed vertically the strongly directional plane will be the elevation plane and the perpendicular weakly directional plane will be the azimuth plane.

2. Description of the prior art

One prior art directional radiocommunication array as described above has adjacent radiating elements in the form of four colinear half-wave dipoles energized in series by a main line with an impedance Zc. If ZT is the impedance as seen at the input of the secondary lines connecting the main line to the dipoles, the impedance matching condition at the array input is:

$$Zc=4ZT$$

which gives $Zc=200\ \Omega$ with $ZT=50\ \Omega$, the characteristic value for a coaxial line. In this case the main line must be a two-wire line, because of the serial feed. These lines have higher power losses and more importantly radiate a strong interference field. This is one drawback of this prior art directional array, another being related to the problem of implementing the junction or transition between the high-impedance two-wire main line and the low-impedance coaxial secondary lines.

To overcome these drawbacks it is possible to feed the dipoles directly in pairs using dividers by two or a single divider by four. This standard solution has the advantage of simplicity in design and can give satisfactory performance. However, it has high manufacturing (matched symmetrical dipoles with fixing interface to a reflecting mast, for example) and high component costs (numerous cables and connectors, power dividers).

One object of the present invention is to overcome in a simple and inexpensive manner the technical problem of providing a directional radiocommunication array as described above having good radioelectric characteristics and in particular that is free of power losses and radiated interference.

SUMMARY OF THE INVENTION

In one aspect the present invention consists in a directional radiocommunication array comprising an array of N adjacent radiating elements connected in series by a main line and spaced by a quarter-wavelength on said main line wherein said directional array comprises an insulative substrate on a first side of which are disposed along a first direction adjacent radiating elements in the form of thin metal layers, each radiating element comprising a radiating slot which widens in a linear manner to either side of an axis from a short-circuited secondary slot line on said axis perpendicular to said first direction and parallel to a second or main propagation direction, each radiating element is isolated from an adjacent element by a decoupling short-circuited quarter-wavelength slot line, and said main line is a coaxial cable substantially perpendicular to each secondary slot line and having a central core and an outer conductive sheath, the sheath of said coaxial cable being stripped at each secondary line over a length substantially equal to the width of said secondary line and connected to two excitation points of said secondary line in the case of the first N−1 radiating elements, the sheath and the central core of the coaxial cable being connected to respective excitation points for the Nth and final radiating element.

By appropriate choice of the dimensions of the radiating slot and the secondary line it is possible to adjust the impedance ZT of each radiating element to a value approximating 50/N Ω where N is the total number of radiating elements so that it is possible to use as the main line a coaxial cable with a characteristic impedance of 50 Ω and the advantages of low power dissipation and virtually no radiated interference.

If perfect impedance matching cannot be achieved, because of overall size constraints, for example, matching may be improved by terminating the coaxial cable with a quarter-wave transformer. To reduce the turns ratio of said transformer each radiating element advantageously comprises a capacitor in the form of a thin metal film deposited onto a second side of the substrate, opposite said first side. This arrangement makes it possible to group the impedance ZT of a radiating element around the value 50/N. A similar result can be obtained if two matching lines are disposed one on each side of said radiating slot.

Because the radiating elements are spaced by one wavelength on the main line they transmit or receive in phase. The main propagation direction is then perpendicular to the first direction defined by the row of elements along the array. A directional array in accordance with the invention can nevertheless be used to transmit or to receive a signal in any direction in the elevation plane. To this end a phase-shift is applied to each radiating element so as to define in the plane of said first and second directions a secondary propagation direction different than said main direction.

In a second aspect the present invention consists in a set of directional arrays disposed parallel to and equidistantly spaced from each other in which each directional array is a directional radiocommunication array comprising an array of N adjacent radiating elements connected in series by a main line and spaced by a quarter-wavelength on said main line wherein said directional array comprises an insulative substrate on a first side of which are disposed along a first direction adjacent radiating elements in the form of thin metal layers, each radiating element comprising a radiating slot which widens in a linear manner to either side of an axis from a short-circuited secondary slot line on said axis perpendicular to said first direction and parallel to a second or main propagation direction, each radiating element is isolated from an adjacent element by a decoupling short-circuited quarter-wavelength slot line, and said main line is a coaxial cable substantially perpendicular to each secondary slot line and having a central core and an outer conductive sheath, the sheath of said coaxial cable being stripped at each secondary line over a length substantially equal to the width of said secondary line and connected to two excitation points of said secondary line in the case of the first N−1 radiating elements, the sheath and the central core of said coaxial cable being connected to respective excitation points of the Nth and final radiating element and in which a phase-shift is applied to each main line so as to define a propagation direction in a plane perpendicular to said set.

This provides for azimuth scanning in the horizontal plane, for example.

The following description with reference to the appended drawings given by way of non-limiting example only will explain what the invention consists in and how it may be put into effect.

BRIEF DESCRIPTION OF THE DRAWINGS

FIG. 2 a side view of a radiating element of the array from FIG. 1.

FIG. 3*a* is a front view of the radiating element from FIG. 2.

FIG. 3*b* is a front view of the end radiating element.

DETAILED DESCRIPTION OF THE INVENTION

Figure 1:
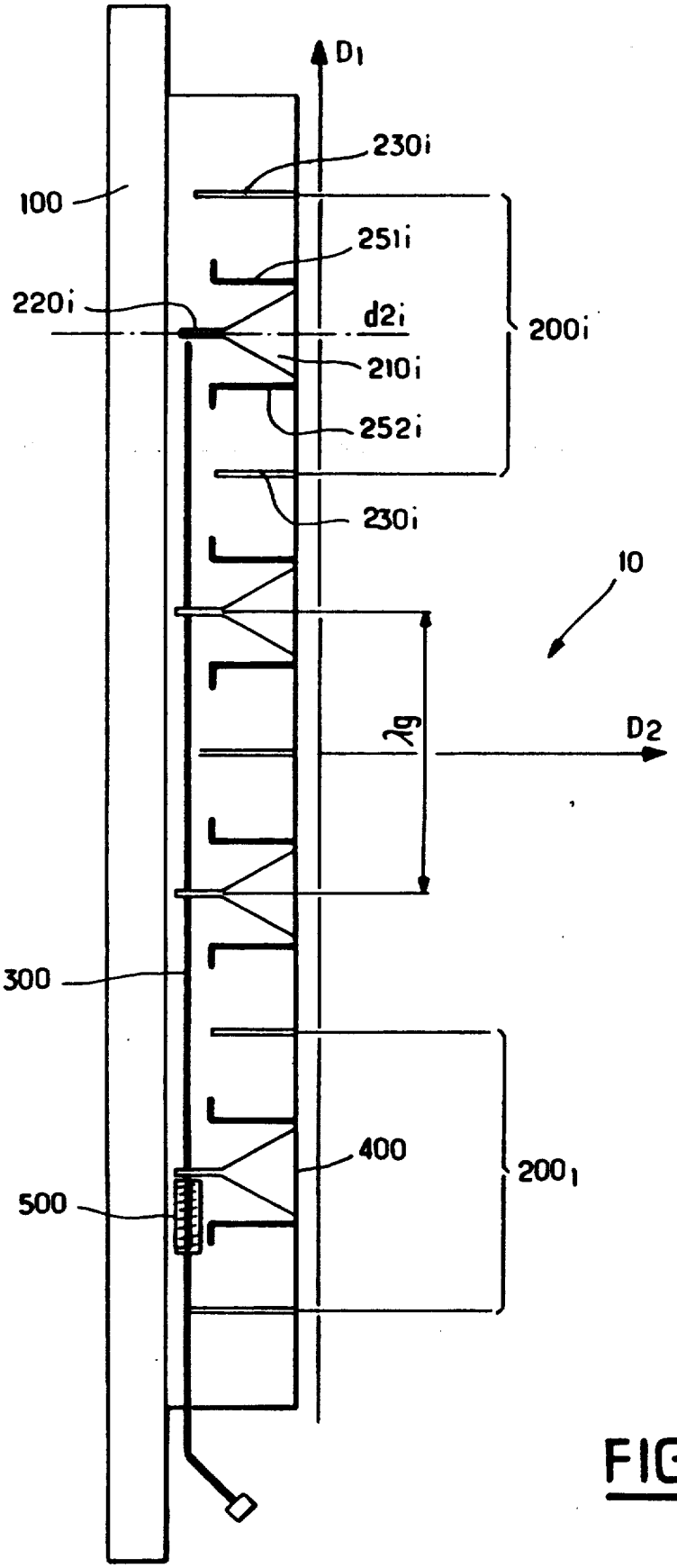
FIG. 1 is a side view of a directional array in accordance with the invention with adjacent radiating elements.

FIG. 1 shows in side view a directional radiocommunication array 10 fixed to a cylindrical or square mast 100 providing a support and possibly a reflector for the array to shape the directivity in the horizontal plane to suit the required application. The array comprises a plurality of N=4 radiating elements $200_i$ (i=1, . . . , N) connected in series by a main line 300 which is either a feed line if the array is a transmit array or a collector line if the array is a receive array. As shown in FIG. 1, the radiating elements $200_i$ are spaced by one so-called guided wavelength λg on the main line 300. For example, with a center frequency Of of 925 MHz and a wavelength in vacuum λ of 320 mm, the guided wavelength λg for a PTFE-insulated cable is approximately 0.7 λ or 224 mm.

FIGS. 1, 2 and 3 show that the directional array is in the form of an insulative substrate 400, of glassfiber-reinforced epoxy resin, for example, on a first side of which are disposed along a first direction $D_l$ the radiating elements $200_i$ formed as thin metal layers using printed circuit technology. Each radiating element $200_i$ comprises a radiating slot $210_i$ which widens in a linear manner to either side of an axis $d_{2i}$ from a short-circuited secondary slot line $220_i$ on the axis $d_{2i}$ perpendicular to the first direction $D_1$ and parallel to a second or main propagation direction $D_2$. To isolate, the radiating elements from each other each element $200_i$ has at least one decoupling short-circuited quarter-wave slot line $230_i$.

Figure 4:
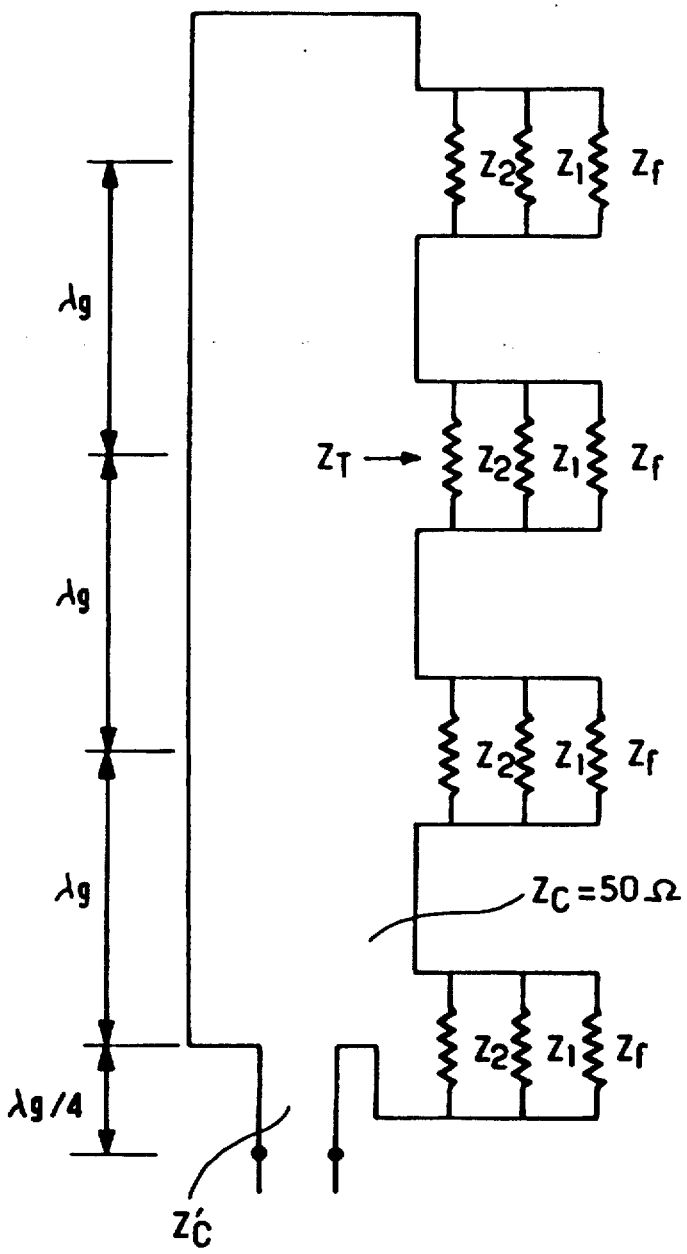
FIG. 4 is a equivalent electrical circuit diagram of the directional array from FIG. 1.

The thin film technology employed and the chosen configuration of the radiating slot $210_i$ and the short-circuited slot secondary line $220_i$ yield a slot impedance Zf which is relatively low and makes it possible to use as the main line 300, a standard semi-rigid coaxial cable having a central core 320 and a conductive outer sheath 310. This line then has a characteristic impedance Zc of 50 Ω. For perfect matching the slot impedance Zf must be equal to 50/N = 12.5 Ω if N=4 radiating elements. If it is not possible to obtain this ideal value there are various ways to obtain a good impedance match, in particular by varying the distance between the coaxial cable and the short-circuit on the secondary line $220_i$, the impedance decreasing as the cable moves towards said short-circuit. Each radiating element $220_i$ also includes a capacitor $240_i$ in the form of a thin metal film deposited onto a second side of the insulative substrate 400 opposite said first side, at the secondary line $220_i$ excitation points A, B. This capacitor has a value of a few picofarads and presents an impedance Zl in parallel with the slot impedance Zf, as shown in the equivalent circuit diagram in FIG. 4. It is also possible to etch two matching lines or stubs $251_i$ and $252_i$ one on each side of the radiating slot $210_i$ These two matching stubs preferably have a length equal to or slightly greater than λ/4. However, if the width of the substrate in the direction $d2_i$ is not sufficient, the matching lines $251_i$ and $252_i$ can be folded symmetrically to avoid generating a crossed interference field. The impedance Z2 produced by the matching stubs contributes to matching the impedance ZT as seen from the secondary line input. Finally, to complete the matching of the impedance of the array a quarter-wave transformer 500 of appropriate turns ratio (preferably a low turns ratio) is disposed at the end of the main line 300.

The directional array therefore has the appearance of a very thin plate of metal-coated substrate with a height in the order of Nλg and a width substantially greater than or equal to λg/4.

A directional array has been made with a secondary line impedance ZT of 18 Ω. To obtain an impedance of 50 Ω at the entry of main line 300, the transformer 500 then requires an impedance Z'c of:

$$Z'c = \sqrt{50 \times 4 \times 18} = 60\ \Omega$$

A practical way to implement the transition between the coaxial cable and the slot secondary line $220_i$ is, as shown in FIG. 3*a*, by stripping the sheath 310 of the cable at each secondary line over a length substantially equal to the width of said secondary line and by connecting said sheath, for example by soldering, to two excitation points A, B of said secondary line for the first N−1 radiating elements. For the Nth and last radiating element, as shown in FIG. 3*b*, the sheath 310 and the central core 320 are respectively connected to the excitation points A and B to form a short-circuit at the end of the line and so to close the circuit electrically.

Figure 5:
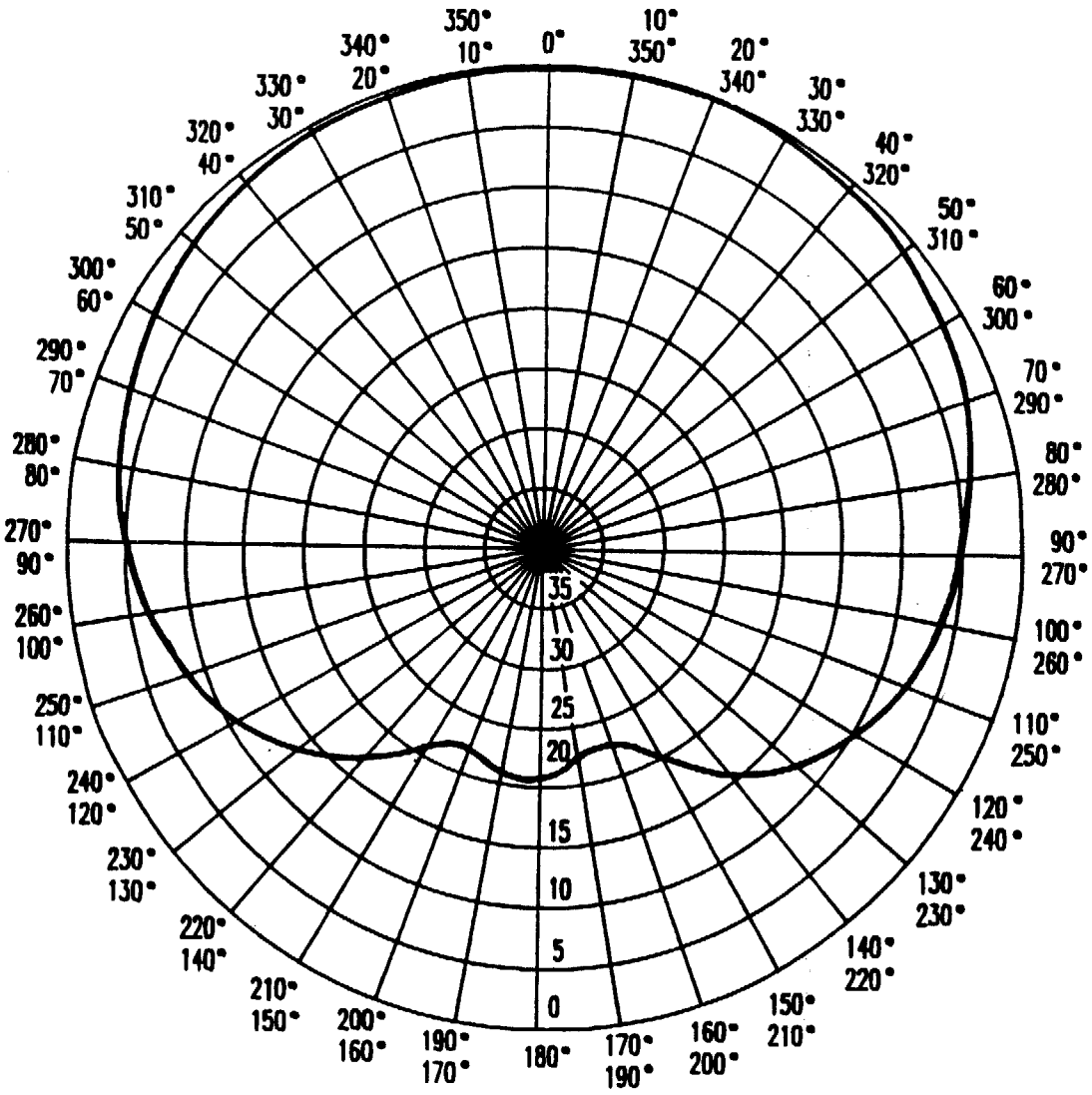
FIGS. 5 and 6 shows and polar diagrams in the horizontal plane at the mid-band frequency for main and cross polarization, respectively.
Figure 6:
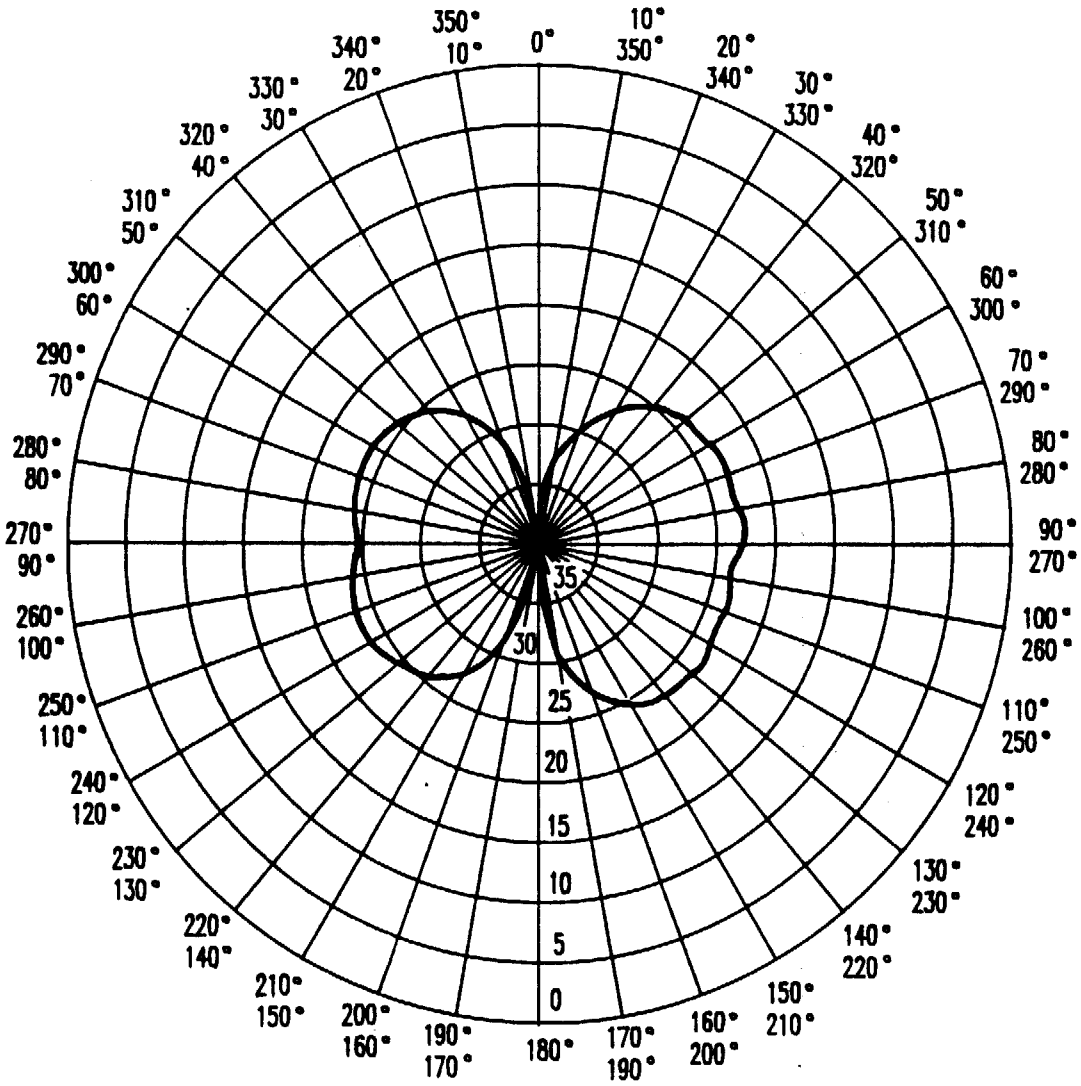

FIGS. 5 and 6 shows the polar diagrams as measured in the horizontal plane and at the mid-band frequency Fo for main and cross polarizations, respectively. Note the low level of cross polarization, which is more than 22 dB down on the main polarization. The directivity of the main diagrams is weak, the attenuation at ±90° from the main radiating direction being only in the order of 5 dB, which is highly favorable, for example, to omnidirectional horizontal polar diagrams in a circular array combining multiple (2, 4 or 8) directional arrays in accordance with the invention.

Figure 7:
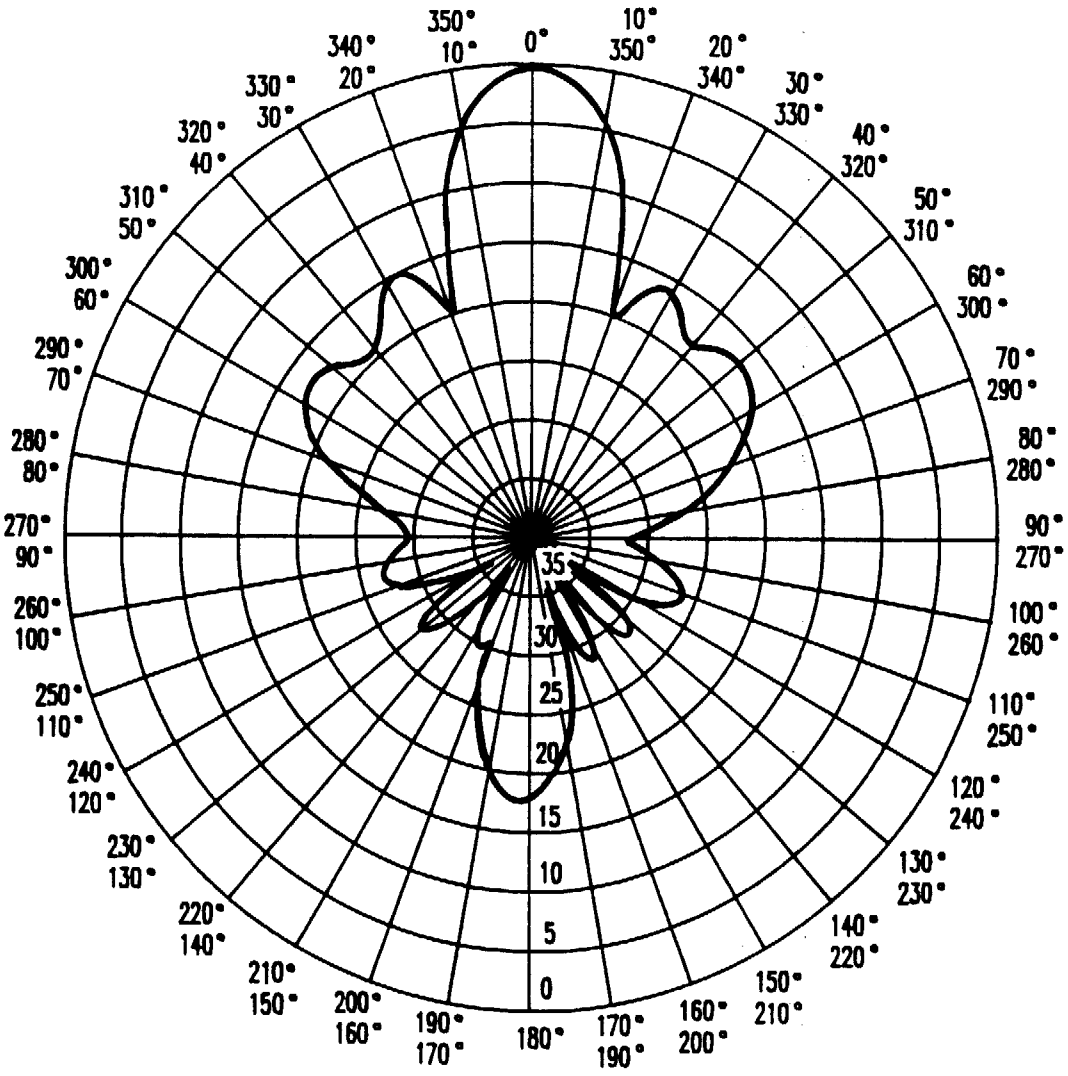
FIGS. 7 and 8 shows polar diagrams in the vertical plane at the mid-band frequency for main and cross polarization, respectively.
Figure 8:
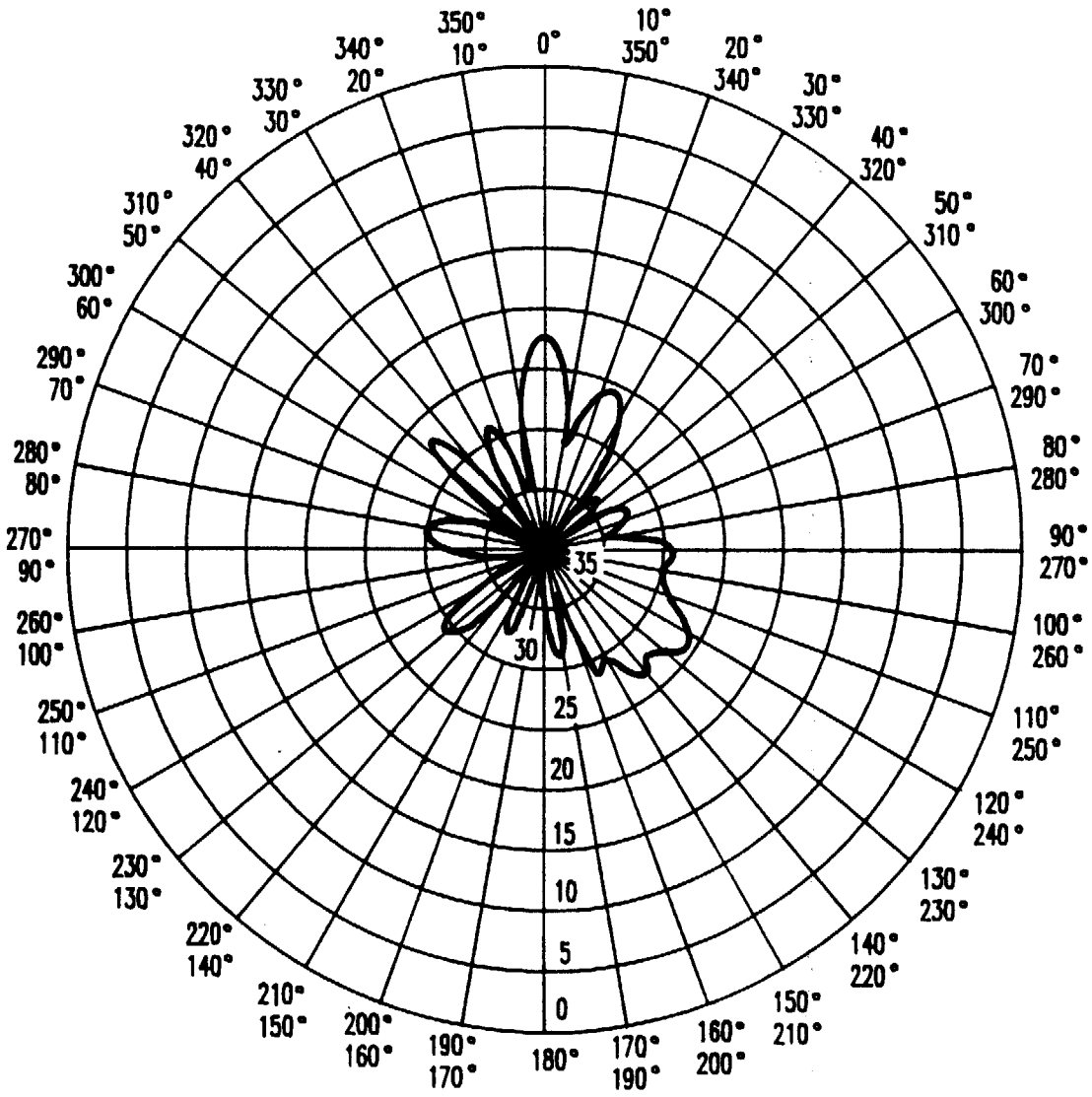

FIGS. 7 and 8 show the polar diagram as measured at the center frequency Fo in the vertical plane $D_1$, $D_2$ containing the array for the main and cross polarizations, respectively. Note that the cross polarization is expanded 10 dB relative to the corresponding main polarization. These diagrams show that the 3 dB aperture of the beam is around 17°, as represented by the well-known approximate formula:

$$\theta\ 3\ dB\ \#51\ \frac{\lambda}{L}$$

in which L is the total length of the directional array.

Depointing of the beam relative to the horizon is feasible by virtue of the inherent principle of series connection of the radiating elements. At the center frequency Fo there is no depointing because all the slots are in phase and the wavefront is vertical. At the frequency Fo+ΔF and for a progressive wave linear array the inclination of the wavefront would be:

$$a = \text{Arcsin}\ \frac{\lambda}{d}\ \frac{\Delta F}{Fo}$$

where d=λg is the distance between two successive slots of the array. This formula would give a depointing of around ±3° in an 8% band. However, an array in accordance with the invention has stationary waves rather than progressive waves and the wavefront inclination is smaller, depending in fact on the individual impedances of the slots, the coupling between the slots and other diffraction phenomena.

The lateral or secondary lobes are more than 15 dB below the main lobe maximum and in an 8% band the level of the secondary lobes is still more than 12 dB below this maximum. A simplified theoretical treatment yields a level of 11.5 dB as the normalized array factor is in this case:

$$F4\ (\theta) = \frac{1}{4}\ ,\ \frac{\sin\left[4\ \frac{\pi d}{\lambda}\ \cos\theta\right]}{\sin\left[\frac{\pi d}{\lambda}\ \cos\theta\right]}$$

where $\theta$ is the polar angle from the zenith. The weighting introduced by the individual diagram of a slot and the strict non-uniformity of excitation of the slots explain the low levels of the secondary lobes, which is obviously favorable to good concentration of the radiated energy in the beam.

Finally, cross polarization in the vertical plane is extremely low by virtue of the specific design features of the array.

With radiating elements in phase the main propagation direction $D_2$ is perpendicular to the array direction $D_1$. To obtain any propagation direction in the plane $D_1$, D2 (the vertical plane), a phase-shift must be applied at each successive radiating element, which offers the possibility of electronic scanning of the beam.

Figure 9:
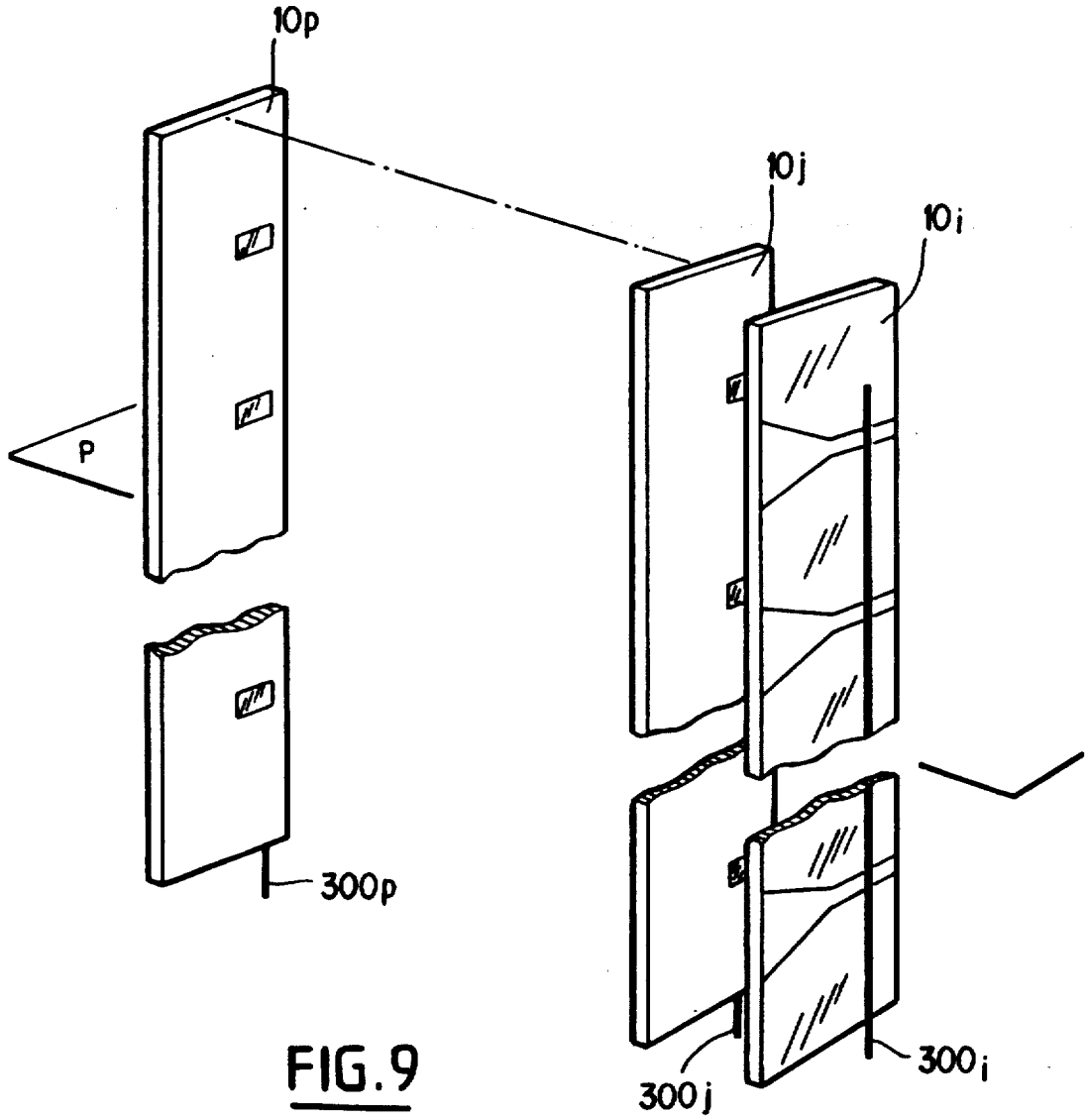
FIG. 9 is a perspective view of a set of directional arrays in accordance with the invention.

FIG. 9 shows a set of P directional arrays $10_j$ with j varying from 1 through P disposed parallel to and equidistantly spaced from each other. To define an azimuth propagation direction in a horizontal plane P perpendicular to said set a phase-shift is applied to each main line $300_j$. Azimuth scanning is achieved by varying this phase-shift by electronic means.

The isotropic gain of a directional array in accordance with the invention has been measured by comparison with a reference antenna. The gain is very close to 10 dBi. This is simply explained by the fact that four aligned radiating elements each having a gain of approximately 2 dBi and forming a linear array disposed a quarter-wavelength in front of a reflecting mast providing an additional gain of around 3 dBi produce a gain of 11 dBi. The measured value is explained by technological losses and losses by reflection at the input to the array and by the fact that the reflective mast is not infinite.

There is claimed:

1. Directional radiocommunication array comprising an array of N adjacent radiating elements connected in series by a main line and spaced by one wavelength on said main line wherein said directional array comprises an insulative substrate on a first side of which are disposed along a first direction adjacent radiating elements in the form of thin metal layers, each radiating element comprising a radiating slot which widens in a linear manner to either side of an axis from a short-circuited secondary slot line oh said axis perpendicular to said first direction and parallel to a second or main propagation direction, each radiating element is isolated from an adjacent element by a decoupling short-circuited quarter-wavelength slot line, and said main line is a coaxial cable substantially perpendicular to each secondary slot line and having a central core and an outer conductive sheath, the sheath of said coaxial cable being stripped at each secondary slot line over a length substantially equal to the width of said secondary slot line and connected to two excitation points of said secondary slot line in the case of the first N−1 radiating elements, the sheath and the central core of said coaxial cable being connected to respective excitation points of the Nth and final radiating element.

2. Directional radiocommunication array according to claim 1 wherein said coaxial cable is terminated by a quarter-wavelength impedance transformer at the excitation points of the secondary slot lien fo the first radiating element.

3. Directional radiocommunication array according to claim 1 wherein each radiating element comprises a capacitor formed by a thin metal layer deposited onto a second side of said substrate opposite said first side.

4. Directional radiocommunication array according to claim 1 wherein two matching lines are disposed one on each side of said radiating slot.

5. Directional radiocommunication array according to claim 1, wherein two matching liens are disposed one on each side of said radiating sot, said matching lines being folded symmetrically and obtained by etching.

6. Set of directional arrays disposed parallel to and equidistantly spaced from each other in which each directional array is a directional radiocommunication array comprising an array of N adjacent radiating elements connected in series by a main line and spaced by one wavelength on said main line wherein said directional array comprises an insulative substrate on a first side of which are disposed along a first direction adjacent radiating elements in the form of thin metal layers, each radiating element comprising a radiating slot which widens in a linear manner to either side of an axis from a short-circuited secondary slot line on said axis perpendicular to said first direction and parallel to a second or main propagation direction, each radiating element is isolated from an adjacent element by a decoupling short-circuited quarter-wavelength slot line, and said main line is a coaxial cable substantially perpendicular to each secondary slot line and having a central core and an outer conductive sheath, the sheath of said coaxial cable being stripped at each secondary line over a length substantially equal to the width of said secondary slot line and connected to two excitation points of said secondary slot line in the case of the first N−1 radiating elements, the sheath and the central core of said coaxial cable being connected to respective excitation points of the Nth and final radiating element and in which a phase-shift is applied to each main line so as to define a propagation direction in a plane perpendicular to said set.

7. Directional radiocommunication array comprising an array of N adjacent radiating elements connected in series by a main line and spaced by one wavelength on said main line wherein said directional array comprises an insulative substrate on a first side of which are disposed along a first direction adjacent radiating elements in the form of thin metal layers, each radiating element comprising a radiating slot obtained by printed circuit technology which widens in a linear manner to either side of an axis from a short-circuited secondary slot line on said axis perpendicular to said first direction and parallel to sa second or main propagation direction, each radiating element is isolated from an adjacent element by a decoupling short-circuited quarter-wavelength slot line obtained by printed circuit technology, and said main line is a coaxial cable substantially perpendicular to each secondary slot line and having a central core and an outer conducive sheath, the sheath of said coaxial cable being stripped at each secondary slot line over a length substantially equal to the width fo said secondary slot line and connected to two excitation points of said secondary slot line in the case of the first N−1 radiating elements, the sheath and the central core of said coaxial cable being connected to respective excitation points of the Nth and final radiating element, two matching lines obtained by etching being disposed one on each side of said radiating slot, said matching liens being folded symmetrically and having a length equal to or slightly greater than a quarter wavelength, each radiating element comprising a capacitor formed by a thin metal layer deposited onto a second side of said substrate opposite sad first side.

8. Directional radiocommunication array comprising an array of N adjacent radiation elements connected in series by a main line and spaced on said main line wherein said directional array comprises an insulative substrate on a first side of which are disposed along a first direction adjacent radiating elements in the form of thin metal layers, each radiating element comprising a radiating slot which widens in a linear manner to either side of an axis from a short-circuited secondary slot line on said axis perpendicular to said first direction and parallel to a second or main propagation direction, each radiating element is isolated from an adjacent element by a decoupling short-circuited quarter-wavelength slot line and said main line is a coaxial cable substantially perpendicular to each secondary slot line and having a central core and an outer conductive sheath, the sheath of said coaxial cable being stripped at each secondary slot line over a length substantially equal to the width of said secondary slot line and connected to two excitation points of said secondary slot line in the case fo the first N−1 radiating elements, the sheath and the central core of said coaxial cable being connected to respective excitation points o the Nth and final radiating element, wherein the radiating elements are spaced on said main line so that a phase shift is applied at each radiating element so as to define in the plane of said first and second directions a secondary propagation direction different than said main direction.

* * * * *